United States Patent [19]

Nicely

[11] Patent Number: 4,503,579

[45] Date of Patent: Mar. 12, 1985

[54] SPONGE-HOLDING DEVICE

[76] Inventor: Garland L. Nicely, 1702 Hollandale Rd., Richmond, Va. 23233

[21] Appl. No.: 608,180

[22] Filed: May 8, 1984

Related U.S. Application Data

[63] Continuation-in-part of Ser. No. 488,220, Apr. 25, 1983, abandoned.

[51] Int. Cl.[3] ..... A47L 13/257

[52] U.S. Cl. ..... 15/244 A; 15/144 R; 15/147 R

[58] Field of Search ..... 15/244 R, 244 A, 244 B, 15/244 C, 228, 230.17, 147 R

[56] References Cited

U.S. PATENT DOCUMENTS 2,955,311 10/1960 Jurkanis ..... 15/244 R
3,412,416 11/1968 Simon ..... 15/244 R

FOREIGN PATENT DOCUMENTS 1039526 5/1953 France ..... 15/244 R
1280749 11/1961 France ..... 15/244 R

*Primary Examiner*—Edward L. Roberts
*Attorney, Agent, or Firm*—Norman B. Rainer

[57] ABSTRACT

A sponge-holding device is provided for the releasable engagement of sponges as may be used in a sponge mop. The device is comprised of a base plate having mounting means for pivoted attachment of the extremity of an elongated handle, and a pair of holding pins for securing a rectangular sponge to the underside of the base plate. The holding pins, having a pointed extremity, are caused to pass through an aperture in the base plate, penetrate the sponge, and engage further supporting structure on the underside of the base plate.

3 Claims, 4 Drawing Figures

SPONGE-HOLDING DEVICE

RELATED APPLICATIONS

This is a continuation-in-part application based upon application Ser. No. 488,220, filed 04/25/83 now abandoned.

BACKGROUND OF THE INVENTION

This invention concerns a device for holding a sponge intended to be utilized at the extremity of an elongated handle for the treatment of surfaces, such as in the cleaning or painting of surfaces.

Sponge mops have become widely used for cleaning purposes in household and industrial applications. Basically these mops involve a synthetic open-celled sponge, typically a block of regenerated cellulose, having a base plate or mounting plate adhesively bonded to the upper surface and provided with means for attachment to the extremity of an elongated mop handle. The sponge and associated mounting plate constitute a mophead which after extended use is replaceable by a new mophead, thus restoring the mop. Similar sponge-manipulating devices are also utilized for applying paint to flat surfaces.

Such mopheads are considerably more expensive than the sponge alone because of the cost of the hardware constituting the mounting plate, and the expense of attaching the sponge thereto. It would therefore be preferable to replace only the sponge portion of the mophead. Sponge mops which disclose replaceable sponges are disclosed in U.S. Pat. Nos. 3,412,416; 3,041,651; 2,955,311; 1,941,550 and 3,787,919. However, the sponge mops of the aforesaid Patents either require specially contoured sponges, or involve mechanical holding devices of considerable complexity, said factors contributing to the cost and fallibility of the sponge mops.

It is accordingly an object of the present invention to provide a novel, simple and efficient holder for securing an ordinary, inexpensive rectangular sponge to an elongated handle.

It is a further object of this invention to provide a holder of the aforesaid nature which easily engages and securely holds a sponge for its intended use, yet easily disengages said sponge when desired.

It is still another object of the invention to provide an improved sponge holder of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved sponge-holding device which comprises:

(a) a base plate of generally rectangular periphery having two opposed parallel end edges equidistantly disposed about a lateral plane of symmetry that perpendicularly bisects said base plate, opposed parallel side edges equidistantly disposed about a longitudinal plane of symmetry that perpendicularly bisects said base plate at a right angle to said lateral plane of symmetry, a flat upper face region, a flat lower face region, and a border zone adjacent each end edge and angled downwardly toward said lower face region, (b) mounting means centrally positioned upon said upper face region and adapted to pivotably engage the extremity of an elongated handle, (c) a pair of holding pins having straight portions adapted to be disposed in generally parallel relationship to said longitudinal plane of symmetry, each pin having a head extremity and a pointed extremity capable of penetrating a sponge, (d) first support means adapted to support the head extremity of said pins in a location below said lower face region, and comprising apertures associated with said border zones, and (e) second support means associated with said base plate and adapted to support the pointed extremity of said pins in a manner such that the straight portions of said pins are disposed below said lower face region and substantially parallel thereto.

In a preferred embodiment, the base plate and mounting means are of integral monolithic construction, having been fabricated from a rectangular piece of sheet metal stock by cutting and bending operations. In another preferred embodiment, both holding pins are straight and are threaded adjacent their pointed extremities thereby enabling engagement with threaded end engaging means. It is further preferred that first and second support means are identical and comprised of apertures within said border zones adapted to receive said pins.

In use, the base plate is placed atop the flat surface of a sponge and centered thereon so that the sponge extends beyond the entire perimeter of the base plate. The pointed extremities of the pins are inserted through apertures in the border zones and caused to penetrate the sponge which is flexed upwardly to receive said pins. The pointed extremities are then supported by engagement with the apertures of the opposite border zone or are secured by alternative second support means associated with the base plate. End engaging means such as threaded nuts or equivalents may be utilized to prevent dislodgement of the pointed extremities.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
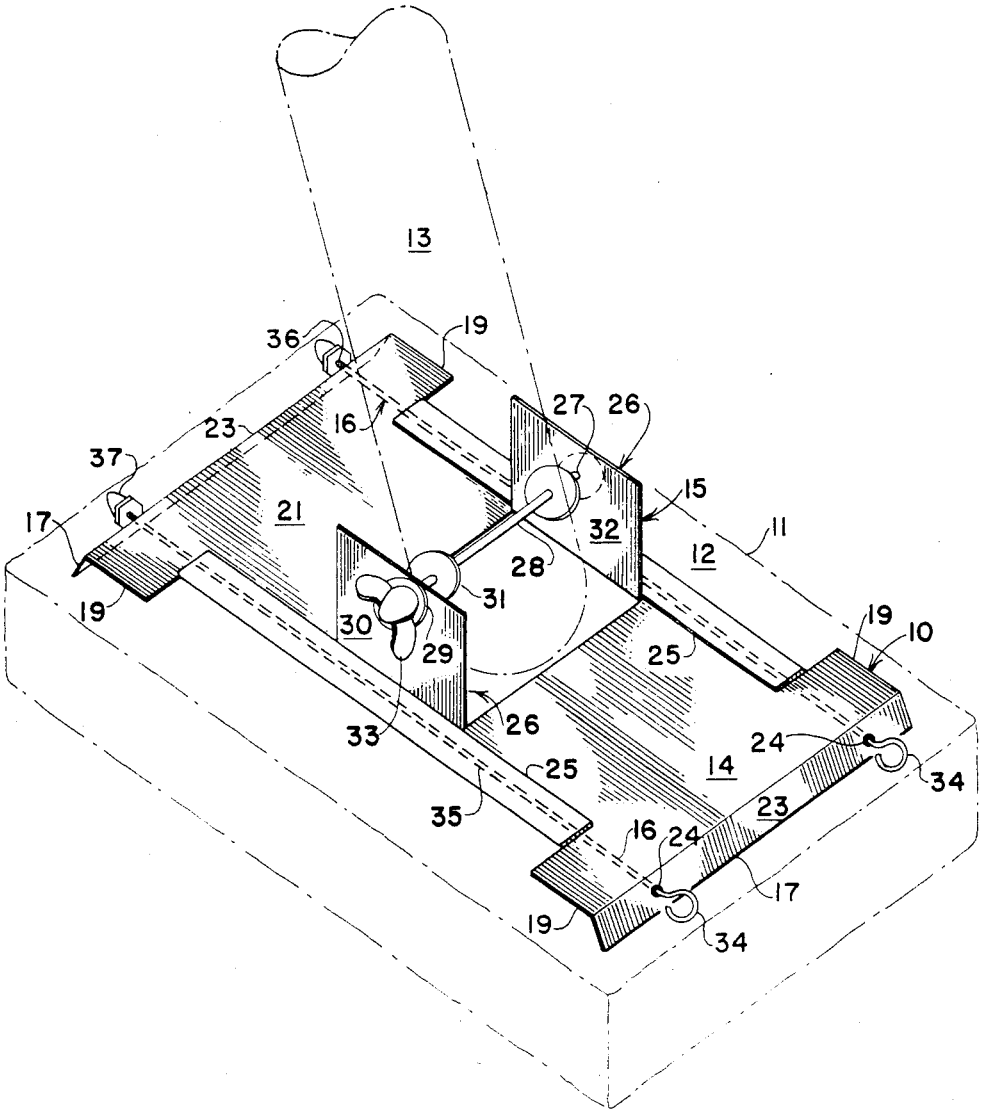
FIG. 1 is a perspective top view of an embodiment of the sponge-holding device of the present invention showing functional association with a sponge and an elongated handle.
Figure 2:
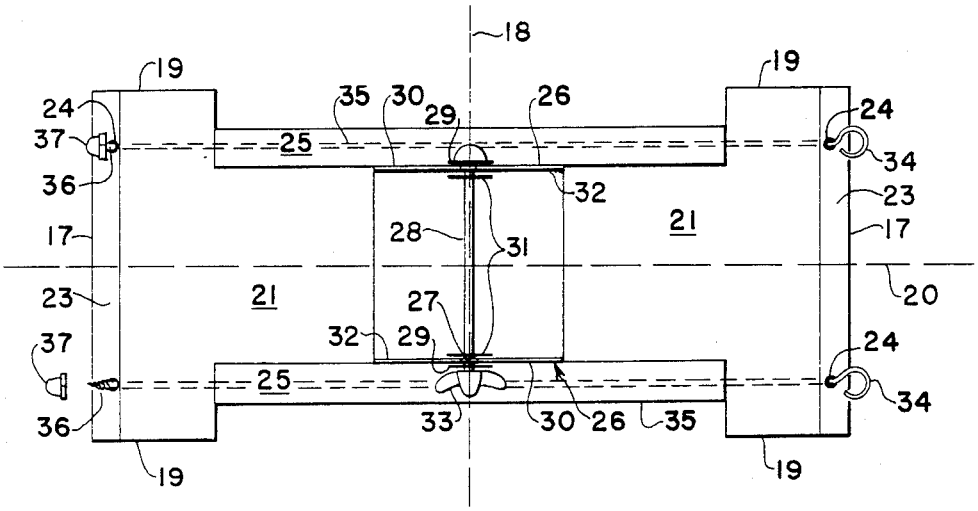
FIG. 2 is a top plan view of the embodiment of FIG. 1.
Figure 3:
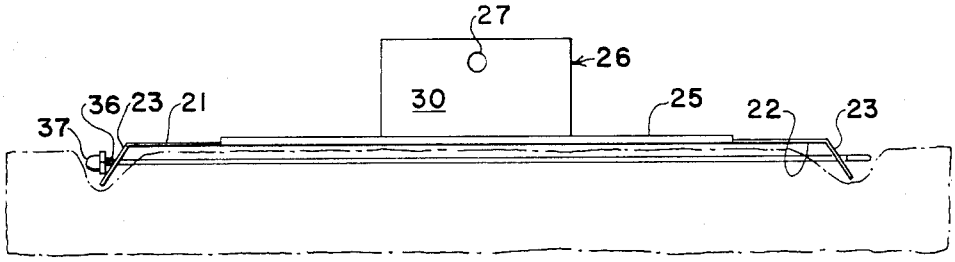
FIG. 3 is a side view of the embodiment of FIG. 1.

Referring to FIGS. 1–3, a sponge-holding device 10 of the present invention is shown in operative association with a rectangular cellulose sponge 11 having flat upper face 12, and in further association with the lower extremity of an elongated handle 13. The sponge-holding device is comprised of base plate 14 of generally rectangular periphery, mounting means 15 centrally positioned upon said base plate, and paired holding pins 16 which traverse the entire length of the base plate.

Base plate 14 is seen to have two opposed parallel end edges 17 equidistantly disposed about a lateral plane of symmetry indicated by dashed line 18 of FIG. 2, and opposed parallel side edges 19 equidistantly disposed about a longitudinal plane of symmetry indicated by dashed line 20. Said planes of symmetry are disposed perpendicularly to said base plate as bisectors thereof, and intersect at right angles at the center of said base plate. Base plate 14 is further comprised of flat upper face region 21, flat lower face region 22, and a border zone 23 adjacent each end edge and downwardly angled toward said lower face region. Border zones 23 of the illustrated embodiment are continuous integral extensions of the flat regions of the base plate, formed merely by a bending operation. Each border zone contains two laterally spaced apertures 24.

Reinforcing side strips 25 are incorporated into the base plate of the embodiment of FIGS. 1–3 by an operation comprising cutting inwardly from side edges 19 to form a tab-like appendage, and folding said appendage into flush-fitting contact with upper face region 21. The purpose of said side strips is to provide structural reinforcement for mounting means 15, as will hereinafter be shown.

Mounting means 15 are comprised of: (a) upwardly directed opposed mounting tabs 26 which are continuous integral extensions of said base plate, having been formed by cutting and bending operations, and containing apertures 27, (b) threaded bolt 28 spanning said mounting tabs by passage through apertures 27, (c) metal lock washers 29 on bolt 28 contiguous to the outwardly directed surfaces 30 of tabs 26, (d) fiber or nylon washers 31 disposed on said bolt adjacent the inwardly directed surfaces 32 of said tabs, and (e) a wing nut 33 disposed on the headless extremity of bolt 28. Handle 13 is caused to engage said bolt in a manner to be pivotable thereabout, but controllable by adjustment of wing nut 33. The close proximity of side strips 25 to tabs 26 causes a desirable stiffening reinforcement of the base plate in the vicinity of the mounting means.

Holding pins 16 are each comprised of a head 34, straight shaft portion 35, and pointed threaded extremity 36. The length of the pins is such as to permit spanning traversal of border zones 23 beneath the base plate in a manner such that head 34 is in abutment with one border zone and pointed extremity 36 threadably engages cap nut 37 drawn to abutment with the other border zone. The border zones in combination with the apertures contained therein may be considered to be support means for holding pins 16.

Figure 4:
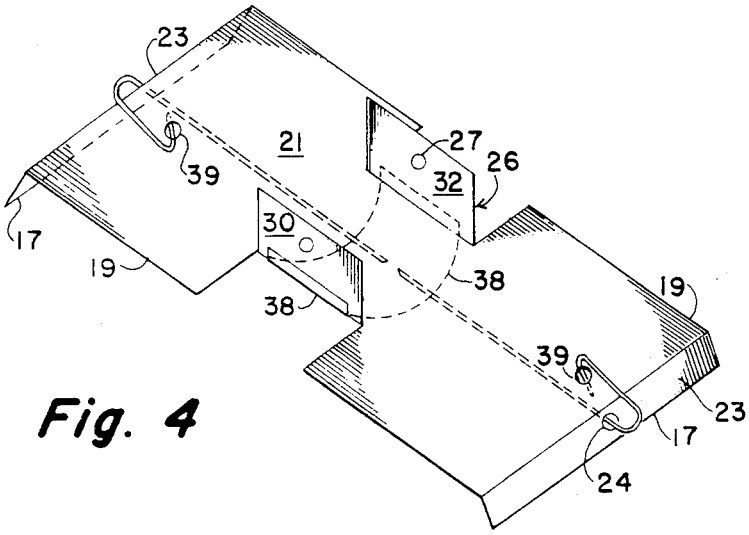
FIG. 4 is a perspective view of an alternative embodiment of the sponge-holding device of this invention.

In the alternative embodiment of sponge-holding device of this invention shown in FIG. 4, holding pins 16, instead of extending completely across the base plate, extend only about halfway to engagement with second support means in the form of pendant band 38 attached to the outwardly directed surfaces of tabs 26 adjacent the lower extremities thereof. By virtue of the specially curved portion of the holding pin of FIG. 4 and specially provided auxiliary engaging aperture 39, no head or cap nut is required at either extremity of the pin.

Although the base plate has been exemplified as fabricated from sheet metal by cutting and bending, equivalent structures can be fabricated from engineering grade plastic by molding operations. Special threaded fittings may be held by threaded bolt 28, thereby permitting engagement of the threaded lower extremity of a handle. The mounting means may be comprised of ball joint or swivel fittings to provide further maneuverability to the sponge-holding device.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An improved device for holding a sponge having a flat upper surface comprising:

(a) a base plate of generally rectangular periphery having two opposed parallel end edges equidistantly disposed about a lateral plane of symmetry that perpendicularly bisects said base plate, opposed parallel side edges equidistantly disposed about a longitudinal plane of symmetry that perpendicularly bisects said base plate at a right angle to said lateral plane of symmetry, flat upper and lower face regions, and a border zone adjacent each end edge and angled downwardly toward said lower face region, (b) mounting means centrally positioned upon said upper face region and adapted to pivotably engage the extremity of an elongated handle, (c) a pair of holding pins having straight portions adapted to be disposed in generally parallel relationship to said longitudinal plane of symmetry, each pin having a head extremity and a pointed extremity capable of penetrating a sponge, (d) first support means adapted to support the head extremities of said pins in a location below said lower face region, and comprising apertures associated with said border zones, and (e) second support means, associated with said base plate and adapted to support said pins adjacent their pointed extremities in a manner such that the straight portions of said pins are disposed below said lower face region and substantially parallel thereto.

2. The device of claim 1 wherein said base plate is fabricated from an integral piece of metal sheet stock.

3. The device of claim 2 wherein the pointed extremities of said pins are threaded and are engaged by a protective nut.

* * * * *